United States Patent [19]

Sultzbaugh

[11] Patent Number: 4,573,689

[45] Date of Patent: Mar. 4, 1986

[54] GAME

[76] Inventor: S. Ray Sultzbaugh, 3900 Parkview La., #11-A, Irvine, Calif. 92715

[21] Appl. No.: 639,841

[22] Filed: Aug. 13, 1984

[51] Int. Cl.[4] ..... F41J 1/00; A63F 5/04

[52] U.S. Cl. ..... 273/348; 273/145 R

[58] Field of Search ..... 273/398–402, 273/348, 156, 145 R, 146, 148 R

[56] References Cited

U.S. PATENT DOCUMENTS

| | | | |
|---|---|---|---|
| 659,352 | 10/1900 | Park | 273/348 |
| 2,799,502 | 7/1957 | Isakson | 273/399 |
| 3,175,826 | 3/1965 | Davis | 273/145 R |
| 3,208,754 | 9/1965 | Sieve | 273/146 |
| 4,319,755 | 3/1982 | Orser | 273/401 |

FOREIGN PATENT DOCUMENTS

| | | | |
|---|---|---|---|
| 259924 | 11/1927 | United Kingdom | 273/156 |

*Primary Examiner*—Paul E. Shapiro

*Attorney, Agent, or Firm*—Edgar W. Averill, Jr.

[57] ABSTRACT

A game board and throwing piece combination. The throwing piece is a regular tetrahedron, and the game board has a plurality of elevations which hold the throwing piece in a manner so that one of its four surfaces is facing upwardly. Preferably, the surfaces of the tetrahedron are marked with numbers or symbols.

9 Claims, 4 Drawing Figures

GAME

BACKGROUND OF THE DISCLOSURE

The field of the invention is games, and the invention relates more specifically to games of the type which typically utilize one or more dice. Dice games of every variety have been devised, but such games are limited by the fact that each dice has six surfaces. Furthermore, the action of a dice on a flat surface is relatively slow moving and more dynamic motion would be advantageous.

SUMMARY OF THE INVENTION

It is an object of the present invention to provide a game board and throwing piece combination wherein the action of the throwing piece is more dynamic than the typical action of a dice on a flat surface.

The present invention is for a game board and throwing piece combination having at least one regular tetrahedron as the throwing piece. The game board has at least three elevated means positioned to form at least one triangular pattern, said elevated means being held in a generally upright manner and being positioned sufficiently close together and having sufficient height so that the regular tetrahedron will rest on them and the upper surface of the regular tetrahedron will be about parallel to the upper surface of the elevated means. Preferably, the throwing piece or pieces have indicia on each surface thereof, and the elevated means comprises a peg having a rounded upper surface.

DESCRIPTION OF THE PREFERRED EMBODIMENTS

The game of the present invention utilizes one or more throwing pieces each of which comprises a regular tetrahedron. The regular tetrahedron is a four-surfaced solid, each surface of which is an equilateral triangle having the same size as each other surface. The tetrahedron has the least number of surfaces that a solid object having flat surfaces can have.

Figure 1:
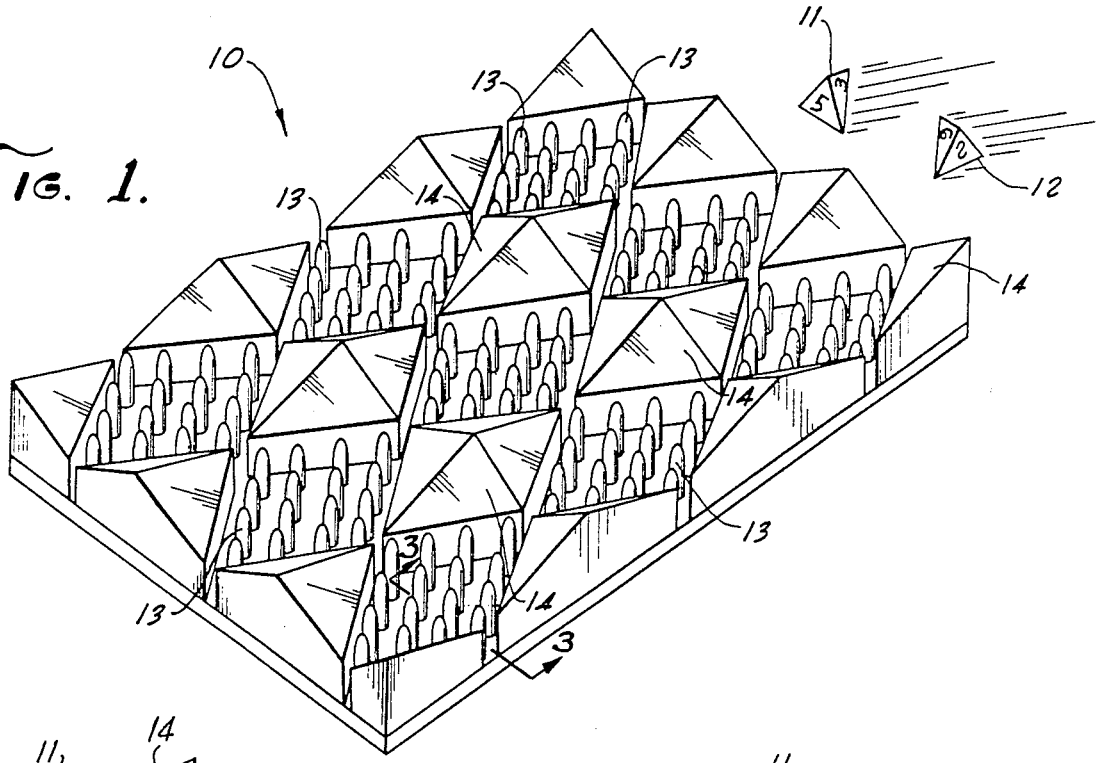
FIG. 1 is a perspective view of a game board and two throwing pieces of the present invention.

Each surface of the tetrahedron is marked with indicia such as a number. It is possible that the indicia on one tetrahedron will be different than the indicia on another tetrahedron and because of the number of surfaces, it is possible to place only even numbers on one tetrahedron and only odd numbers on the other so that the resulting sum of the numbers on the two tetrahedron will always be an odd number. The game pieces are thrown onto a game table 10 which has a plurality of pegs 13 held in an upright manner on a board 15 between a plurality of elevated pyramids 14. The term "elevated pyramids" include half pyramids and quarter pyramids as shown at the edges and corners of the game board of FIG. 1. The pyramids are raised a height which is about equal to the top of the pegs 13. In this manner, the game pieces 11 and 12 will come to rest with one of their four surfaces facing upwardly about parallel to the board 15 of the game board as shown in FIG. 2.

Figure 3:
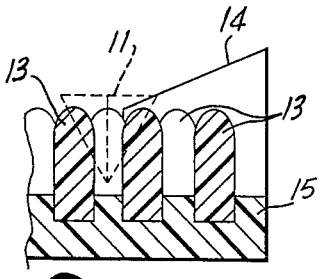
FIG. 3 is an enlarged cross-sectional view taken along line 3—3 of FIG. 1.

One construction of the game board is indicated in FIG. 3 where plastic pegs 13 are held in holes drilled in board 15. board 15 is shown as a plastic member but it could, of course, be wooden or made from another material.

Figure 2:
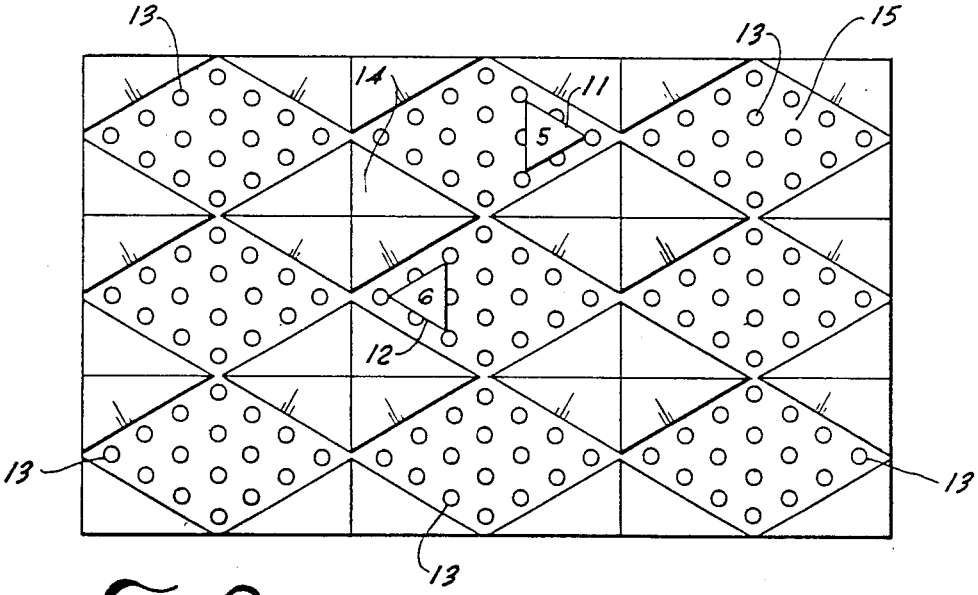
FIG. 2 is a top plan view of the game board and throwing pieces of the present invention.

It is, of course, possible that the game board can comprise only pegs without the pyramids 14 and the game pieces will still come to rest as shown in FIG. 2. The addition of the pyramids 14, however, provides variety in the possible games that can be played with the materials shown in the drawings. Also with the use of pyramids which are spaced apart as shown in FIG. 2, it is possible for a game piece to rest on two adjacent pyramids and one peg. Thus, the pyramids may act as "elevated means" as set forth in the claims.

Figure 4:
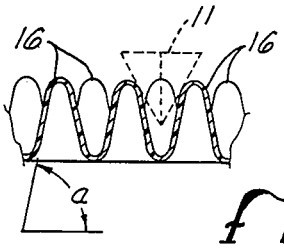
FIG. 4 is an enlarged cross-sectional view of an alternate embodiment of a portion of the game board of the present invention.

An alternate construction of game board is shown in FIG. 4 where pegs 16 are vacuum formed or otherwise molded so that they are integral with the base. This provides a particularly inexpensive form of the game board of the present invention. It is important, however, for proper operation of the board that the peg means support the game pieces at only a point, thus the angle of the side of the peg means should be greater than sixty degrees. This angle is indicated by the letter "a" in FIG. 4.

The game pieces have remarkable action as they first strike the pegs of the game board. They tend to spin and turn very rapidly before quickly stopping in a resting position. The action is much more rapid in movement and much more suddenly stopped than the movement of the conventional dice. Although the game pieces are shown resting in the middle of the space between the pyramids in FIG. 2, it is possible, of course, that the game piece can rest on two pegs and the side of one of the raised pyramids.

It has been found that a particularly useful game results from a tetrahedron having an edge length of one inch and pegs having a height of seven-eighths of an inch positioned with their centers five-eighths inch apart from each other and one-half inch from the edge of the raised pyramid. The pyramids do not have a square base, but instead have a base which is a regular parallelogram having an angle of thirty degrees at one pair of ends and sixty degrees at the other pair of ends. The faces of the pyramids are at an angle of thirty degrees with respect to the horizontal. Pegs useful with the above-described tetrahedron comprise one-quarter inch dowels rounded at the upper surface and having their upper surface at the base of the pyramids. It has also been found preferable to slightly round all corners of the tetrahedron to help reduce the possibility that the tetrahedron will land in some manner other than that where its upper surface is parallel to the game board.

Because of the use of a tetrahedron in place of a normal cube, many different number combinations may be used which are substantially different than that possible with the conventional tetrahedron. It is, of course, also possible to have the same numbers on each throwing piece or to have different colors and the net result is an entirely new combination of possibilities which provide an almost endless variety of possible games. A still further variant can result if the different triangles of pegs are colored differently and the position where the pyramid rests could have a different effect in the game depending on the color of the triangle in which it comes to rest. Thus, it can be seen that a wide variety of new games can be played with the use of a tetrahedron in conjunction with a game board having a plurality of raised or elevated members. By utilizing at least sixteen pegs, a particularly active movement of the game piece results because it is more likely to strike the pegs than if a fewer number of pegs with more pyramids is used. The game board of the present invention can be fabricated by relatively inexpensive methods such as vacuum forming where, instead of pegs, rather steep cones with rounded upper points could be used. The tetrahedron game pieces may be readily made by injection molding or other molding techniques.

The present embodiments of this invention are thus to be considered in all respects as illustrative and not restrictive, the scope of the invention being indicated by the appended claims rather than be the foregoing description. All changes which come within the meaning and range of equivalency of the claims therefore are intended to be embraced therein.

What is claimed is:

1. In a game board and throwing piece combination of the type wherein the throwing piece may land with any of its surfaces facing upwardly depending only on chance, the improvement comprising:

at least one regular tetrahedron which comprises the throwing piece;

a game board having at least three pegs positioned to form a triangular pattern, said pegs being held in a generally upright manner and said pegs being positioned sufficiently close together and having sufficient height so that the regular tetrahedron will be about parallel to the upper surface of the pegs.

2. The combination of claim 1 wherein said throwing piece has indicia on each surface thereof.

3. The combination of claim 1 wherein said game board has at least sixteen pegs.

4. The combination of claim 3 wherein said pegs are positioned to form a plurality of equilateral triangles.

5. The combination of claim 4 wherein said pegs all have their upper terminus in a common plane.

6. The combination of claim 1 further including at least one elevated pyramid.

7. The combination of claim 1 wherein there are two throwing pieces.

8. The combination of claim 1 wherein said game board has a board having a planar surface having a plurality of raised pyramids affixed thereto, said pyramids being oriented so that they touch at their corners and a plurality of pegs are affixed to the board so that the upper surfaces thereof are at about the same height as the edge of said pyramids.

9. The combination of claim 1 wherein said pegs comprise cylindrical pegs having their upper surfaces rounded.

* * * * *